United States Patent [19]

Fujita et al.

[11] 4,273,843

[45] Jun. 16, 1981

[54] METHOD OF DETECTING TONER CONCENTRATION IN ELECTROPHOTOGRAPHIC COPYING MACHINE

[75] Inventors: Hisao Fujita; Kiyoshi Kimura, both of Hachioji, Japan

[73] Assignee: Konishiroku Photo Industry Co., Ltd., Tokyo, Japan

[21] Appl. No.: 45,759

[22] Filed: Jun. 5, 1979

[30] Foreign Application Priority Data

Jun. 12, 1978 [JP] Japan ..... 53-69929
Jun. 12, 1978 [JP] Japan ..... 53-69930

[51] Int. Cl.[3] ..... G03G 15/08
[52] U.S. Cl. ..... 430/30; 430/120; 118/691; 118/665; 118/653; 355/3 DD
[58] Field of Search ..... 430/30, 120; 118/646, 118/691, 665, 653

[56] References Cited

U.S. PATENT DOCUMENTS 3,892,672 7/1975 Gawron ..... 430/30
3,897,748 8/1975 Hirata ..... 118/691

*Primary Examiner*—John D. Welsh
*Attorney, Agent, or Firm*—Bierman & Bierman

[57] ABSTRACT

An apparatus and method for detecting the concentration of toner in a multi-component developer of an electrophotographic copying machine utilizes a source of illumination for projecting light onto the developer, and a receiving element for measuring the intensity of light of a predetermined wavelength reflected from the developer, the predetermined wavelength being of a value selected to maximize the intensity of reflected light in response to variations in toner concentration substantially independently of the reflection characteristics of the developer. The amount or concentration of toner in the developer is varied—by the addition of suitable amounts of toner—with the measured intensity of the received reflection of light of the predetermined wavelength.

7 Claims, 6 Drawing Figures

METHOD OF DETECTING TONER CONCENTRATION IN ELECTROPHOTOGRAPHIC COPYING MACHINE

BACKGROUND OF THE INVENTION

The present invention relates to a method of detecting toner density or concentration in an electrophotographic copying machine in which a so-called two-component developer containing of a carrier such as iron and a toner is used. The invention also concerns an apparatus for carrying out the above method.

Description of the Prior Art

In general, in copying machines for producing visible images with the aid of toner, it has been hitherto known that the density or concentration of toner has to be maintained under control in an appropriate range in order to continuously obtain copied images of a predetermined constant density, because variations in the toner density or concentration will exert corresponding influences to the density of the copied or reproduced image. Heretofore, many proposals have been made as to the toner concentration detecting method. According to a typical known arrangement of an optical detection type, a toner attracting member such as a nesa-glass sheet or the like is disposed at a position at which the toner-attracting member is brought into contact with the developer, while a light emitting element and a light receiving element are disposed in opposition to the toner attracting member, whereby the member deposited with toner in the developing process is illuminated by the light emitting element and light reflected from or transmitted through the toner attracting member is directed to the light receiving element. The electrical output signal from the light receiving element which represents the toner density at the toner attracting member is then compared with a present reference value, thereby to produce a difference signal which is then utilized for controlling the toner concentration. This method is based on the fact that the light reflectance factor of the developer will vary in dependence on the toner concentration. However, it has been found that such optical toner concentration detecting method or apparatus is disadvantageous in that difficulty is encountered in controlling and maintianing the toner concentration even near to the desired proper value. More particularly, because an incandescent light emitted by the light emitting element and illuminating the developer has a wide spectral region and hence the light receiving element is irradiated with reflected light having a correspondingly wide spectral region, the intensity of reflected light will be only leniently decreased as a function of the increase in the toner concentration, as is illustrated by a curve a in FIG. 1. Usually, the toner concentration control is effected by setting a reflection intensity $R_1$ corresponding to a desired optimum toner concentration. However, since the variation in the intensity of reflected light is extremely gentle, as can be seen from the curve a, a slight variation in the characteristics of the light emitting element and the light receiving element constituting the toner concentration detecting system due to temperature changes or such changes as those according to a function of time lapse will result in significant variation in the preset reflection intensity $R_1$ with a width $r_1$ in appearance, thereby involving a correspondingly remarkable variation of a range $d_1$ in the proper toner concentration D. Thus, it becomes difficult to maintain the toner concentration even in the vicinity of the proper value D.

With the present invention, it is contemplated to eliminate the drawback of the hitherto known optical toner concentration control method utilizing the light reflection from the developer as described above. According to the invention, a toner concentration detecting method is provided which allows the control of toner concentration to be effected with an improved accuracy by restricting the wavelength region of light reflected from the developer and sensed by the light receiving element thereby to attain a high responsibility in the output signal from the latter representing the intensity of the reflected light relative to the toner concentration, while suppressing to minimum the influences of characteristic variations of the elements taking part in the toner concentration control as caused by temperature change or the like factors. The prior art method described hereinbefore has other drawbacks described below. More specifically, there is such a relation between the concentration of toner in the developer and the intensity of reflected light as is graphically shown in FIG. 4. The characteristic curves have been obtained by measuring intensity of light reflected from a developer irradiated by a light emitting diode of GaAs type (exhibiting a peak output at the wavelength of 930 nm) by varying the toner concentration contained in the developer. In this connection, it is to be noted that the term "toner concentration" represents toner contents in parts by weight relative to the weight of developer. Referring to FIG. 4, the curve a' represents the data obtained for the developer prior to the use, while the curve b' represents the characteristic of the developer which has been used for producing 30000 copies. It can be seen from the graphic illustration that the light reflection factor of developer will vary in dependence on the toner concentration, and that the reflection factor of the developer of the same toner concentration will be increased in accordance with the developing operation. The latter phenomenon can be explained by the fact that the toner particles tend to be fused and adhere to the carrier particles as the number of developing cycles is increased, whereby contents of so-called spent toner which plays no part in the development is increased. This phenomenon is referred to as "deterioration of developer". It will thus be appreciated that the hitherto known optical apparatus for detecting the toner concentration on the basis of the measured intensity of light reflected from the developer as described hereinbefore is incapable of detecting the toner concentration with a sufficient accuracy because the deterioration of developer is not taken into consideration.

Accordingly, the present invention is intended to eliminate the drawbacks of the conventional method of optically detecting the toner concentration described above, and provide an improved toner concentration detecting method as well as an apparatus for carrying out the same in which the intensity of reflected light is made to correspond definitely to the toner concentration notwithstanding the deterioration of developer.

The present invention starts from the recognition that the carrier contained in the developer exhibits invariably a substantially constant reflectance factor independently from the deterioration of developer as a function of time lapse. Thus, it is possible to determine the toner concentration in the developer with a high accuracy on the basis of the intensity of reflected light of a specific wavelength which is substantially insusceptible to the influence due to the deterioration of developer. In this connection, the term "specific wavelength" is defined to be a wavelength corresponding to a point at which a spectral curve of light reflected from the carrier of the unused developer approaches to or intersects a spectral curve of light reflected from the carrier of the used developer. Further, the phrase "carrier of the unused developer" means literally the carrier constituting a component of a purely fresh developer, while "the carrier of the used developer" means the carrier remaining after usable toner particles have been separated from the developer which had been used for producing about 30000 copies. The carrier of the used developer usually contains 0.1 to 0.2% by weight of the spent toner.

BRIEF DESCRIPTION OF THE DRAWINGS

In the accompanying drawings.

DETAILED DESCRIPTION OF THE PREFERRED EMBODIMENTS

Figure 2:
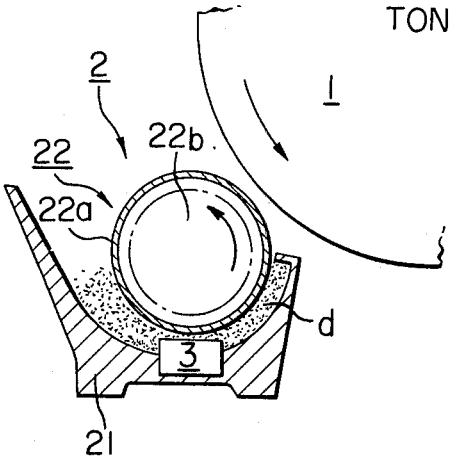
FIG. 2 shows schematically a general arrangement of a developing apparatus of an electrophotographic copying machine.

Referring to FIG. 2 which shows schematically an arrangement of a developing station of an electrophotographic copying apparatus, reference numeral 1 denotes a light sensitive drum (i.e. a drum having a light sensitive peripheral layer) which is rotated at a predetermined velocity in the direction indicated by an attached arrow, and numeral 2 denotes a developing device for developing an electrostatic latent image formed in the peripheral layer of the drum 1 into a visible image (i.e. toner image). The developing device 2 is implemented in a configuration of a so-called magnetic brush type developing device and includes a developer container 21 containing therein a developer d of a two-component system containing carrier such as iron and toner particles, and a developer transporting mechanism 22 disposed so as to be partially immersed in a mass of developer d. The developer transporting mechanism 22 comprises a sleeve **22*a* made of a non-magnetic and electrically conductive material and adapted to be rotated in the direction indicated by an attached arrow, and a circular magnet array 22*b* disposed coaxially within the sleeve 22*a* with a preselected gap to the inner peripheral surface or inner wall of the sleeve 22*a*. Since the developing device of such structure has been heretofore known and does not consitute any essential parts of the invention, further description will be unnecessary. However, it should be mentioned that the sleeve 22*a* may be held stationary with the inner magnet array 22*b*** being rotated.

Figure 1:
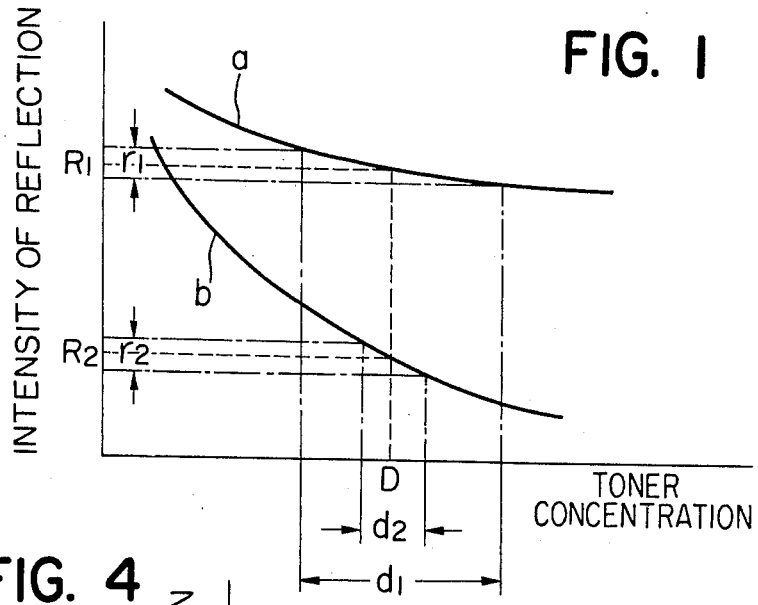
FIG. 1 graphically illustrates a reflected light intensity vs. toner concentration curve obtained according to the invention as compared with the one attained in a hitherto known toner concentration detecting apparatus.
Figure 4:
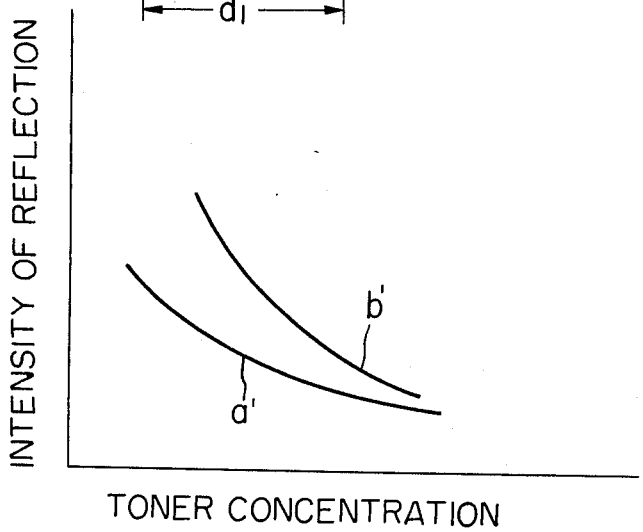
FIG. 4 illustrates graphically relationships between the toner concentration and the intensity of reflected light for both unused and used developers.
Figure 3:
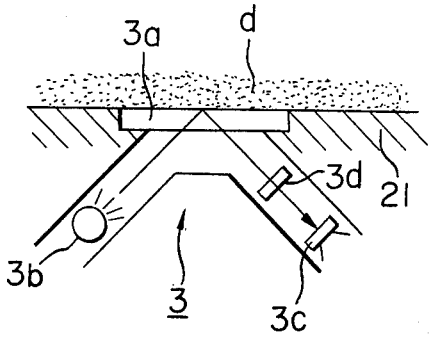
FIG. 3 shows schematically an arrangement of a toner concentration detecting apparatus according to an embodiment of the invention.

Next, referring to FIG. 3, a toner concentration detection apparatus according to an embodiment of the invention as indicated generally by reference numeral 3 is provided at a bottom portion of the developer container 21 and comprises a light emitting source **3*b* for illuminating the developer d through a transparent plate 3*a* disposed in a bottom portion of the developer container 21, and a light receiving element 3*c* for receiving the reflected light from the developer d. A filter 3*d* adapted to pass therethough light in a predetermined wavelength range may be provided in the optical path extending from the light source 3*b* to the light receiving unit 3*c*, if desired. By way of example, an incandescent lamp is used as the light source 3*b* in combination with the light receiving element 3*c* constituted by a silicon blue cell (exhibiting a peak output for the wavelength in the range of 800 nm to 900 nm), while a filter adapted to block the light rays of the wavelength in the range of 700 nm to 1200 nm is used for the filter 3*d*. By using the optical concentration detecting apparatus of the above design, the intensity of reflected light is measured as a function of the toner concentration. The results are illustrated by a curve b in FIG. 1. As can be readily appreciated from this figure, the curve b obtained according to the teaching of the invention has a slope much steeper than that of the curve a attainable with the hitherto known apparatus, which means that variation $r_2$ in the preset intensity of reflection $R_2$ corresponding to a desired toner concentration D due to temperature change or aging variations in the characteristics of the components of the detecting system will involve only a small variation $d_2$ in the measured toner concentration, whereby deviation of the toner concentration from the reference or desired level can be significantly reduced. Such improvement accomplished by the invention can apparently be understood by comparing the width of variation $d_1$ in the case of the hitherto known detecting system with the width $d_2$ attained according to the invention. In the above exemplary experiment, EFV ferreous powder and SP ferreous power (sintered ferreous powder) were used for the carrier. It is conceivable that a light emitting element such as red light emitting diode which does not emit light rays other than those of a specified range of wavelength may be used for the light source 3*b* by sparing the wavelength limiting filter, or alternatively a light receiving element 3*c*** exhibiting an extremely low sensitivity to light of wavelength greater than a predetermined one may be used. Of course, a combination of the light emitting element and the light receiving element of the nature described above may be adopted.

By use of one embodiment of the present invention, variation or change in the intensity of reflected light in response to variation in the toner concentration can be made steeper by blocking spectral components of reflected light in the preselected wavelength region according to the invention, whereby adverse influence of characteristic variations of the sensor components due to temperature change, aging change or the like factors can be suppressed to minimum. Thus, the undesirable variation in the toner concentration relative to the preset intensity of reflection can be significantly reduced, whereby the control of toner concentration can be effected with an enhanced accuracy.

It goes without saying that the invention is never restricted to the developing device of the magnetic brush type described above but can be applied to other types of electrophotographic copying apparatus in which the developer of a two-component system containing carrier and toner is used.

Next, the description of the other embodiment will be described by utilizing FIGS. 5 and 6 together with FIGS. 2 and 3.

Figure 5:
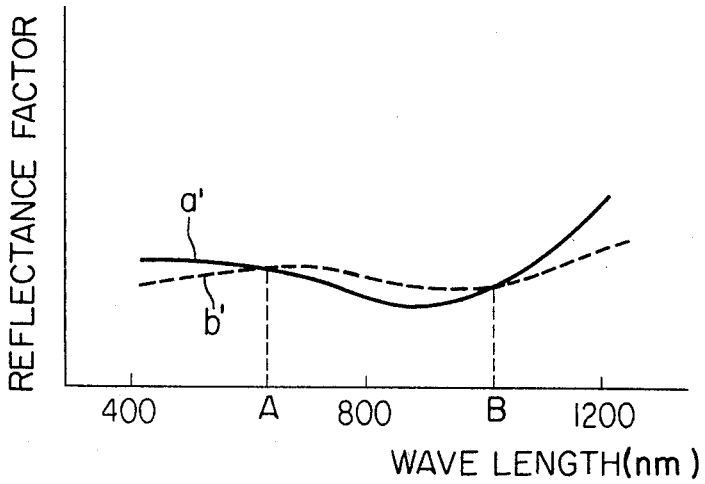
FIGS. 5 and 6 show spectral curves for the carriers contained in the unused and the used developers.

FIG. 5 shows spectral reflectance characteristic curves (spectral curves) of a carrier consisting of sintered ferrous powder (SP powder) plotted on the basis of measurements executed by using a reflection type magnetic spectrometer (manufactured by Hitachi Seisakusho Co. Ltd.). In the figure, the curve a' represents the reflectance factor vs. wavelength characteristic for the carrier of the unused developer (hereinafter referred to as the unused carrier), while the curve b' represents the similar characteristic for the carrier of the used developer (hereinafter referred to as the used carrier) in the sense defined hereinbefore. The carrier of the used developer contains the spent toner particles fused and strick permanently to the surfaces of the carrier particles during the developing process, as described hereinbefore. As can be seen from FIG. 5, the reflectance factor of the unused carrier is equal to that of the used carrier at specified wavelengths A and B. Accordingly, when the wavelength of light emitted from the light emitting element 3*b* shown in FIG. 3 is selected equal to the wavelength A or B or approximations thereof, the influence of the deterioration of developer to the intensity of reflected light can be substantially suppressed, as the result of which variation in the toner concentration of the developer will bring about corresponding variation in the intensity of reflected light with an enhanced accuracy. FIG. 6 is a similar graph to FIG. 5 and shows the spectral characteristic curves (reflectance factor vs. wavelength curve) for the carrier consisting of EFV ferreous powder. As can be seen from the figure, the reflectance factor of the unused carrier becomes substantially equal to that of the used carrier at wavelength C. Accordingly, the influence of deteriorated developer on the intensity of reflected light can be substantially excluded by selecting the wavelength C or approximation thereof, whereby the toner concentration can be detected with a high accuracy.

Figure 6:
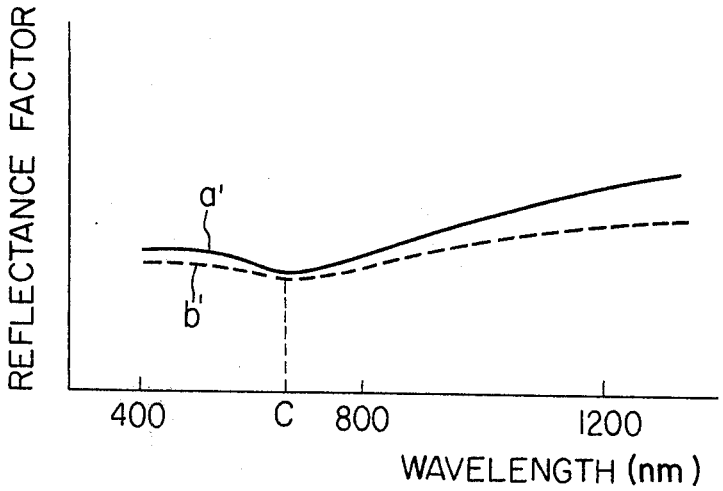

Although time duration required for the spent toner to be produced or the developer to become deteriorated varies in dependence on chemical compositions of the developers being used, it is to be noted that spectral characteristics substantially similar to those illustrated in FIG. 5 or 6 are obtained for any kind of developer composition.

In summary, the invention is based on the discovery that the carrier contained in the developer of the two-component system exhibits a substantially constant reflectance factor at a specific wavelength independently from deterioration of the developer as a function of time lapse and thus the variation in the toner concentration can be positively detected as a corresponding variation in the intensity of light reflected from the developer without being influenced by the deterioration of developer or carrier by using the light irradiation of the specific wavelength.

In order to implement the invention by employing the detector apparatus shown in FIG. 3, the light emitting device 3*b* may be constituted by a light emitting diode, electroluminescence element or the like adapted to be excited at the specific wavelength such as A, B or C, while the light receiving element 3*c* may be a photoelectric converter element exhibiting a substantially uniform sensitivity over the whole range of wavelengths. Alternatively, the light emitting element 3*b* may be constituted by an incandescent lamp exhibiting no peak intensity at the specific wavelength. In this case, the light receiving element has to be implemented by a photoelectric element which exhibits a high sensitivity only at the specific wavelength. Further, the same effect can be accomplished by using a filter 3*d* having a passing band at the specific wavelength A, B or C with an incandescent lamp used for the light source in combination with the photoelectric converter element of the same type as in the former case.

What we claim is:

1. In a method for maintaining substantially constant the concentration of toner in a two-component developer of the type containing toner and carrier particles, the steps of:

projecting light onto the developer, and varying the amount of toner in the developer in accordance with the intensity of light of a preselected wavelength reflected from the developer, said preselected wavelength being of a value selected to maximize the intensity of reflected light in response to variations in toner concentration substantially independently of the reflection characteristics of the developer.

2. In a method of detecting toner concentration of a developer containing carrier and toner and employed in an electrophotographic copying machine, including the steps of projecting light onto the developer, and reflecting the light impinging upon the developer onto a receiving element, the improvement comprising:

preselecting a wavelength of the light reflected onto the receiving element such that the intensity of the reflected light at said preselected wavelength is substantially unaffected by deterioration of the developer, and producing an output in response to the measured intensity of the preselected wavelength of light reflected onto the receiving element for detecting variations in toner concentration by measured changes in said output.

3. In a method according to claim 1, the projected light emanating from an incandescent lamp and the light receiving element comprising a silicon blue cell.

4. In a method according to claims 1 or 2, the preselected wavelength of the light reflected from the developer corresponding to the substantial intersection of a spectral curve of light reflected from the carrier of the developer prior to use thereof and a spectral curve of light reflected from the carrier of the developer after use.

5. An apparatus for detecting the toner concentration of a two-component developer containing carrier and toner and employed in an electrophotographic copying machine, comprising:

a light emitting element disposed at a position for illuminating the developer; and a light receiving element disposed at a position for receiving light emitted by said emitting element and reflected from the developer, said light emitting element exhibiting a high light output intensity substantially at a wavelength at which a spectral curve of light reflected from the carrier of the developer prior to use thereof substantially intersects a spectral curve of light reflected from the carrier of the developer after use.

6. An apparatus for detecting the toner concentration of a two-component developer containing carrier and toner and employed in an electrophotographic copying machine, comprising:

a light emitting element disposed at a position for illuminating the developer; and a light receiving element disposed at a position for receiving light emitted by said emitting element and reflected from the developer, said light receiving element exhibiting increased sensitivity substantially at a wavelength at which a spectral curve of light reflected from the carrier of the developer prior to use thereof substantially intersects a spectral curve of light reflected from the carrier of the developer after use.

7. An apparatus for detecting the toner concentration of a two-component developer containing carrier and toner and employed in an electrophotographic copying machine, comprising:

a light emitting element disposed at a position for illuminating the developer;

a light receiving element disposed at a position for receiving light reflected from the developer; and a filter inserted in an optical path extending from the light emitting element to the light receiving element, said filter primarily passing light of a predetermined wavelength, and said predetermined wavelength substantially corresponding to the wavelength at which a spectral curve of light reflected from the carrier of the developer prior to use thereof substantially intersects a spectral curve of light reflected from the carrier of the developer after use.

* * * * *